US005158239A

United States Patent [19]

Vock et al.

[11] Patent Number: 5,158,239

[45] Date of Patent: Oct. 27, 1992

[54] DISPERSING PROCESS AND STIRRED BALL MILL FOR CARRYING OUT THIS PROCESS

[75] Inventors: Friedrich Vock; Gerd Kissau; Klaus Warnke, all of Münster, Fed. Rep. of Germany

[73] Assignee: BASF Lacke & Farben AG, Münster, Fed. Rep. of Germany

[21] Appl. No.: 642,242

[22] Filed: Jan. 8, 1991

Related U.S. Application Data

[62] Division of Ser. No. 518,273, filed as PCT/EP85/00526, Oct. 9, 1985, abandoned.

[30] Foreign Application Priority Data

Oct. 16, 1984 [DE] Fed. Rep. of Germany ..... 34378669

[51] Int. Cl.[5] ..... B02C 17/16

[52] U.S. Cl. ..... 241/172; 241/73; 241/79.2; 241/79.3; 241/176

[58] Field of Search ..... 241/46.11, 46.17, 73, 241/79.2, 79.3, 172, 171, 176, 180, 21, 24, 30

[56] References Cited

U.S. PATENT DOCUMENTS 3,799,455 3/1974 Szegvari ..... 241/27

FOREIGN PATENT DOCUMENTS 1902152 7/1970 Fed. Rep. of Germany .

*Primary Examiner*—Joseph M. Gorski

*Attorney, Agent, or Firm*—Kenyon & Kenyon

[57] ABSTRACT

The invention relates to a dispersing process in which a mill base consisting of solids and of a liquid phase is conveyed through a stirred ball mill containing a grinding medium, energy is supplied in this stirred ball by rotating rotors, and the solids are dispersed, and wet with the liquid phase, wherein the rotors rotate at such a high speed that the grinding medium moved by them forms, as the result of the centrifugal force, a rotating grinding medium charge which is in contact with the inner wall of the stirred ball mill, a space which is essentially free of a grinding medium being formed in the center of this grinding medium charge, the mill base is fed radially into the stirred ball mill, flows radially through the grinding medium charge in such a way that a centrifugal fluidiesd bed is formed with respect to the grinding medium, and is removed from the space which is free of grinding medium through an apparatus for separating off grinding medium.

19 Claims, 9 Drawing Sheets

DISPERSING PROCESS AND STIRRED BALL MILL FOR CARRYING OUT THIS PROCESS

This application is a division of application Ser. No. 518,273, filed as PCT/EP85/00526, Oct. 9, 1985, and now abandoned.

The invention relates to a dispersing process according to the precharacterising clause of Claim 1.

It is known that solids can be dispersed in a liquid phase, for example pigments and fillers in a solution of a binder, in stirred ball mills by supplying mechanical energy. The stirred ball mills contain a grinding medium, for example sand, and the energy is supplied by the movement of rotors located in the stirred ball mill. In the dispersing processes used to date, 70 to 90% by volume of the grinding chamber of the stirred ball mill is filled with sand. The mill base flows through the grinding chamber in an axial direction. The throughput of the mill base through the container is in general chosen so that the prescribed desired fineness is achieved after one or more passes. This procedure is frequently referred to as the one-pass or multi-pass procedure.

The level of production achievable by this procedure, that is to say the amount of finished mill base produced per hour, can be increased substantially if the procedure described in German Patent Specification 2,230,766 or German Laid-Open Application 1,902,152 is used. In this circulatory procedure, the throughput of mill base through the mill is high, and, after leaving the mill, the mill base flows back into a container, from which it is conveyed again into the mill by means of a pump. The same effect can be achieved if, using the so-called pendulum procedure, the mill base flows through the stirred ball mill with high throughputs from one container into a second container. This process is repeated until the desired fineness is achieved.

Furthermore, it is known that the level of production can be increased when finer grinding media are used. In the circulatory procedure or pendulum procedure described, the high throughput of mill base causes relatively high drag forces to act on the fine grinding medium, which is the conveyed with the flow towards the grinding medium separating system of the stirred ball mill.

In these procedures, achieving a very hard-wearing seal for the moving parts of the stirred ball mill and separating off the grinding medium from the mill base leaving the stirred ball mill present problems. For the latter purpose, sieves are employed, these being exposed to a great deal of wear due to friction with the grinding medium.

It is an object of the invention to provide a dispersing process which overcomes the disadvantages of the prior art and permits rapid and effective dispersing.

The invention therefore relates to a dispersing process according to Claim 1.

Surprisingly, it has been found that this object can be achieved by reducing the relative charge of grinding medium in the container, and choosing the speed of the rotors so that the grinding medium charge forms a hollow rotating cylinder in the stirred ball mill as a result of the centrifugal force.

Because the mill base is fed in radially, the path of the mill base through the grinding medium charge is shorter than in the prior art procedure. This is compensated by virtue of the fact that the mill base has to pass the grinding medium charge more frequently. The drag forces acting radially from the outside towards the inside cause fluidisation of the grinding medium in the centrifugal field. In general, it is advantageous to choose a high radial flow velocity. Surprisingly, in spite of this high flow velocity, very effective dispersing is achieved, the total dispersing time and the cost of monitoring the process being reduced in the circulatory procedure and the pendulum procedure. In this procedure, dispersing of temperature-sensitive goods can also be carried out without difficulty, since only a small increase in the temperature of the mill base can be observed per passage through the stirred ball mill. This supplied heat can readily be removed from the mill base again in an external cooler. In addition, substantial reduction in the dispersing energy employed is achieved with this procedure compared with the procedure involving passes.

In this dispersing process, fine grinding media can be employed with high throughputs through the mill; these grinding media cannot be used in machines corresponding to the prior art because they are carried onto the separation sieve at high throughputs.

Advantageous embodiments of the process according to the invention are described in the subclaims.

The invention also relates to a stirred ball mill for carrying out the dispersing process.

Advantageous embodiments of the stirred ball mill according to the invention are described in Claims 12 to 15.

The invention is illustrated below with reference to the drawings.

Figure 1:
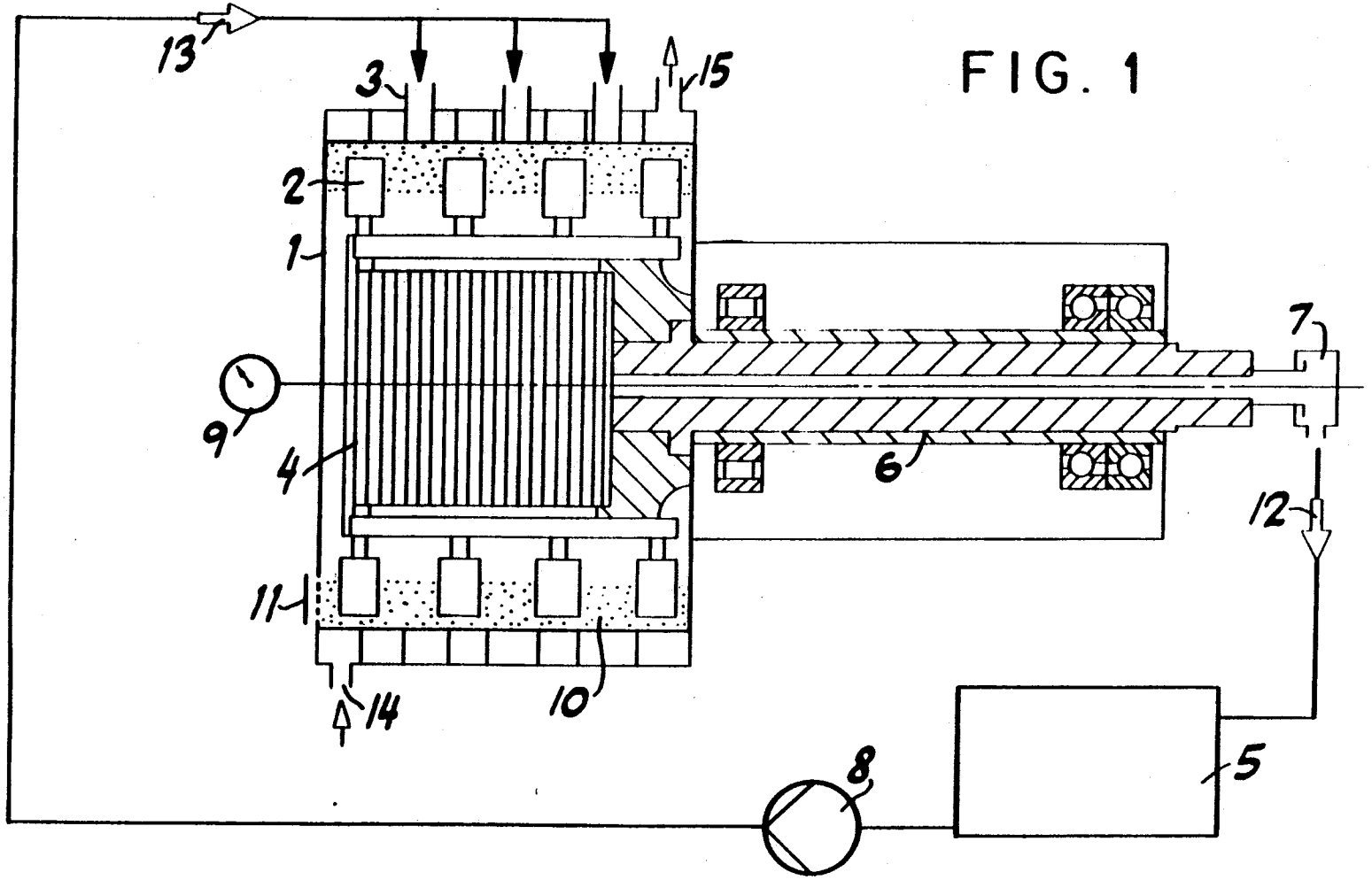
FIG. 1 shows a vertical longitudinal section through a stirred ball mill.
Figure 2:
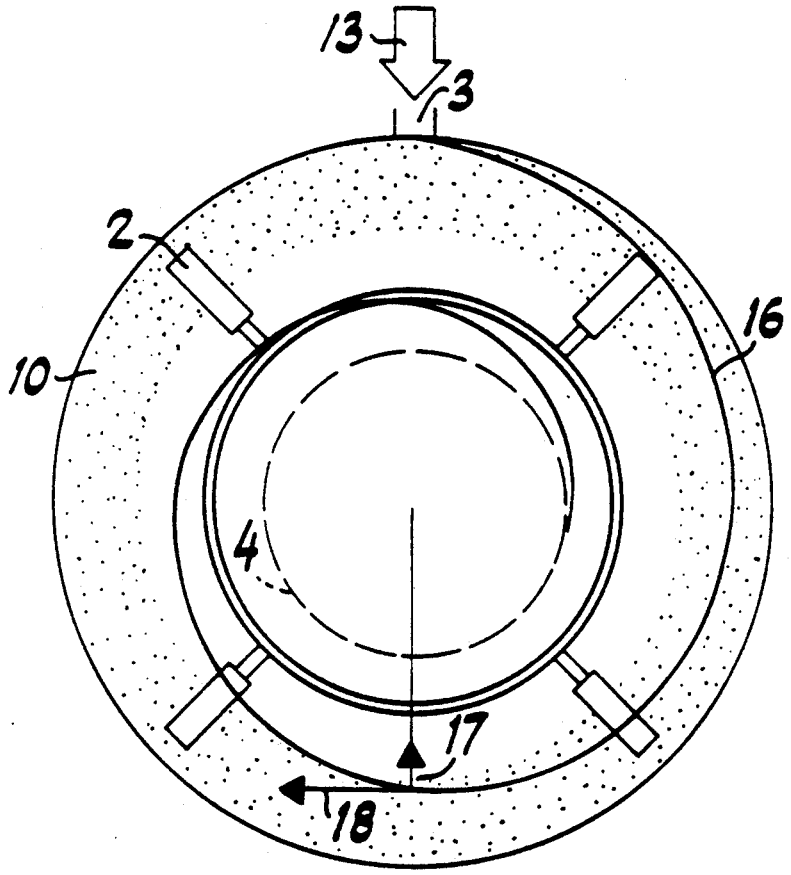
FIG. 2 shows a vertical transverse section through a stirred ball mill.
Figure 3:
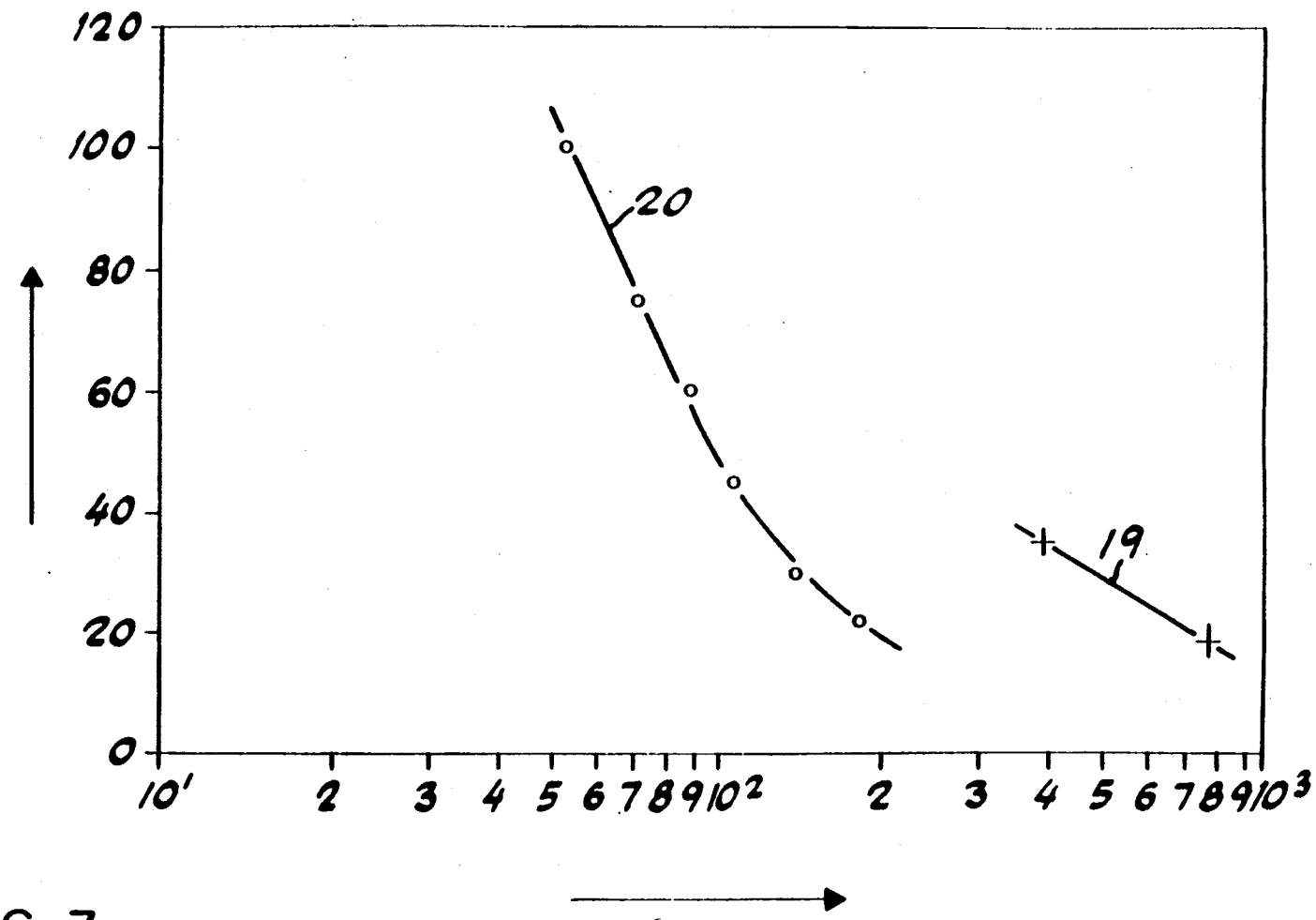
Figure 4:
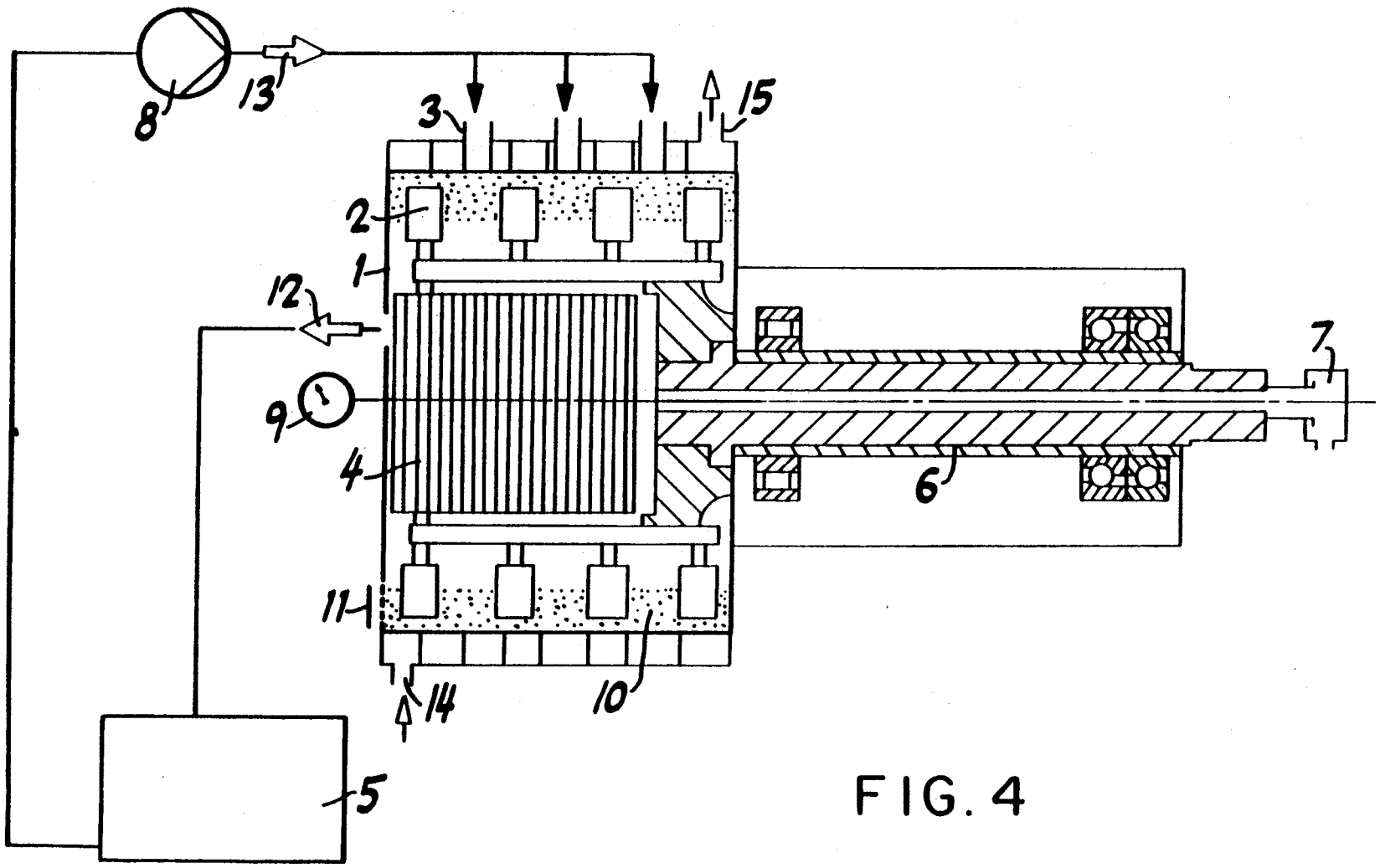
Figure 5:
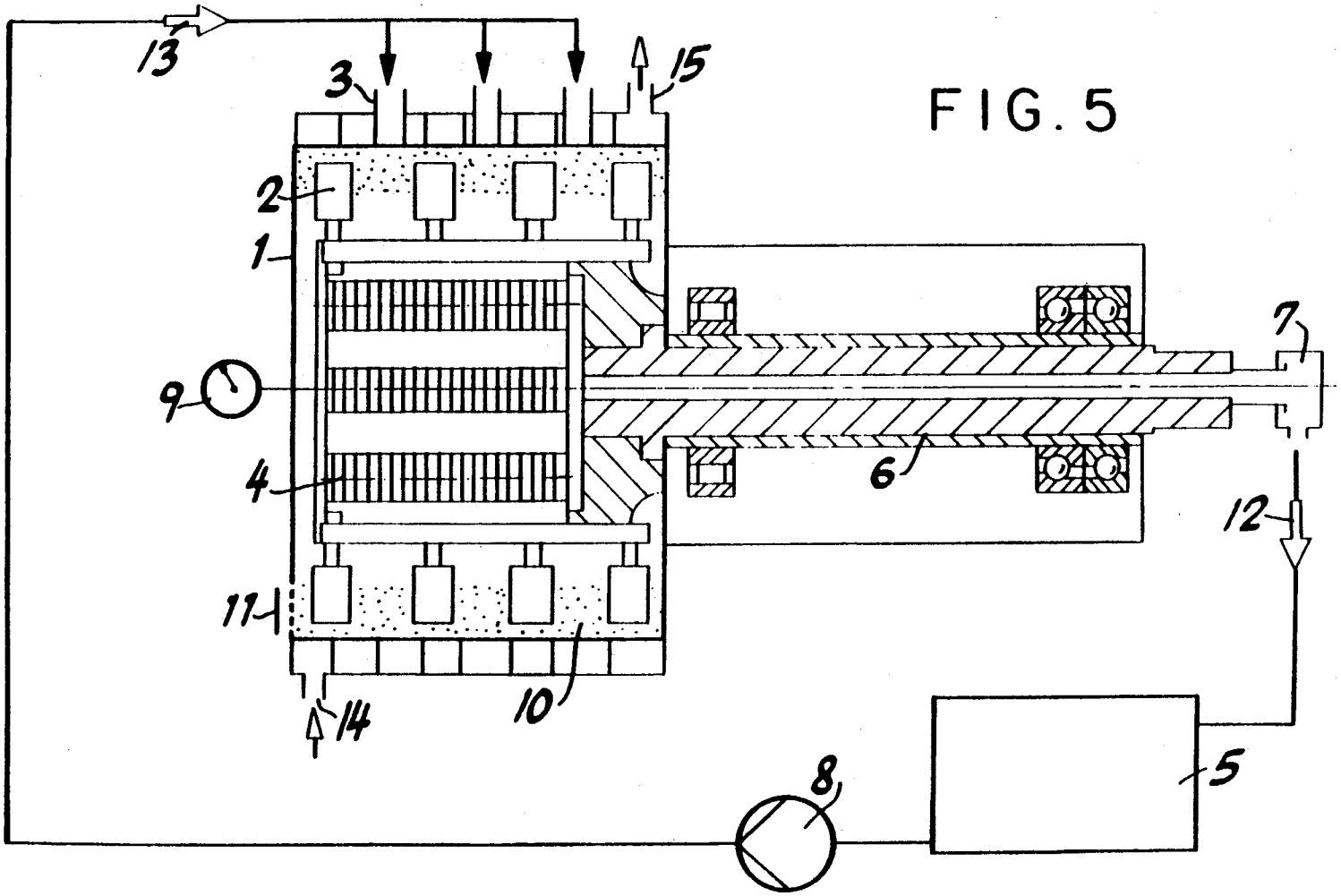
Figure 6:
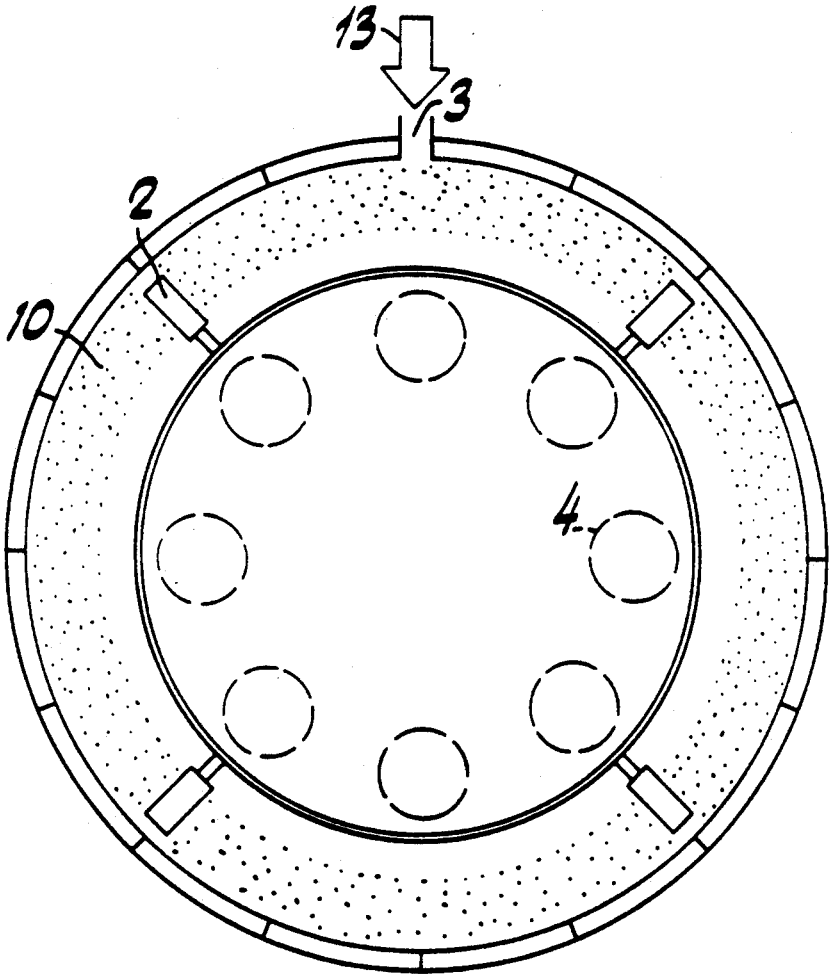
Figure 7:
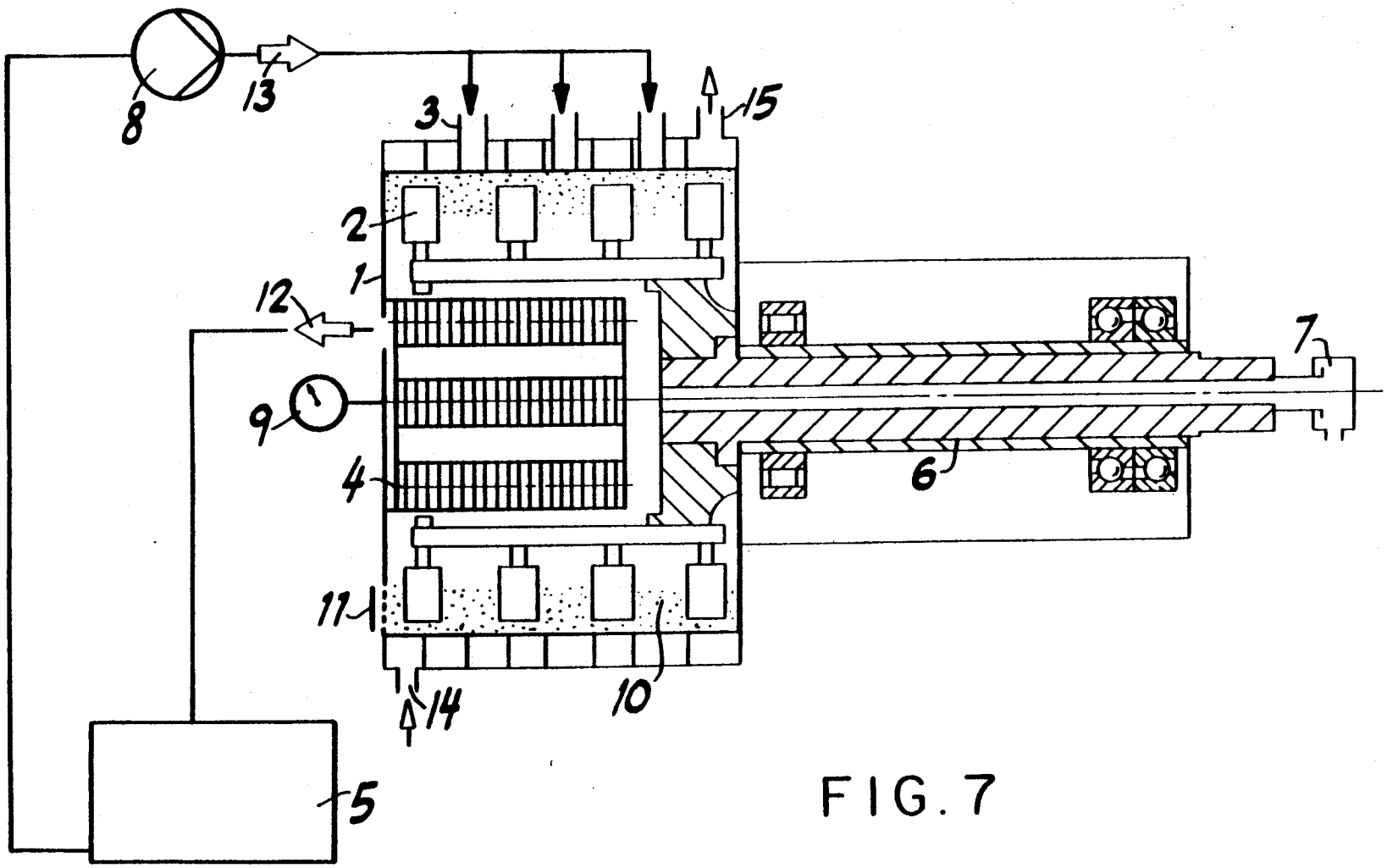
Figure 8:
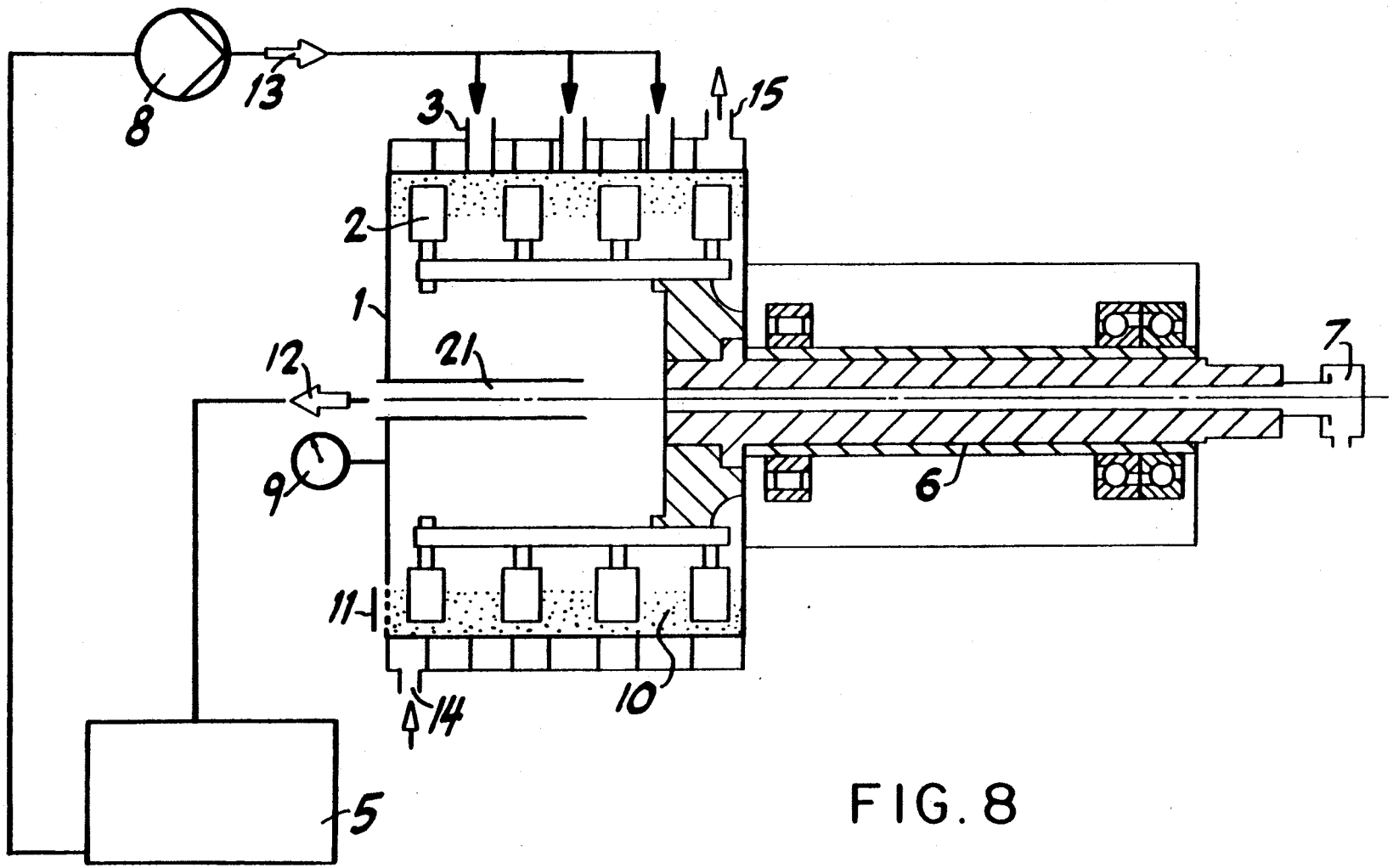
Figure 9:
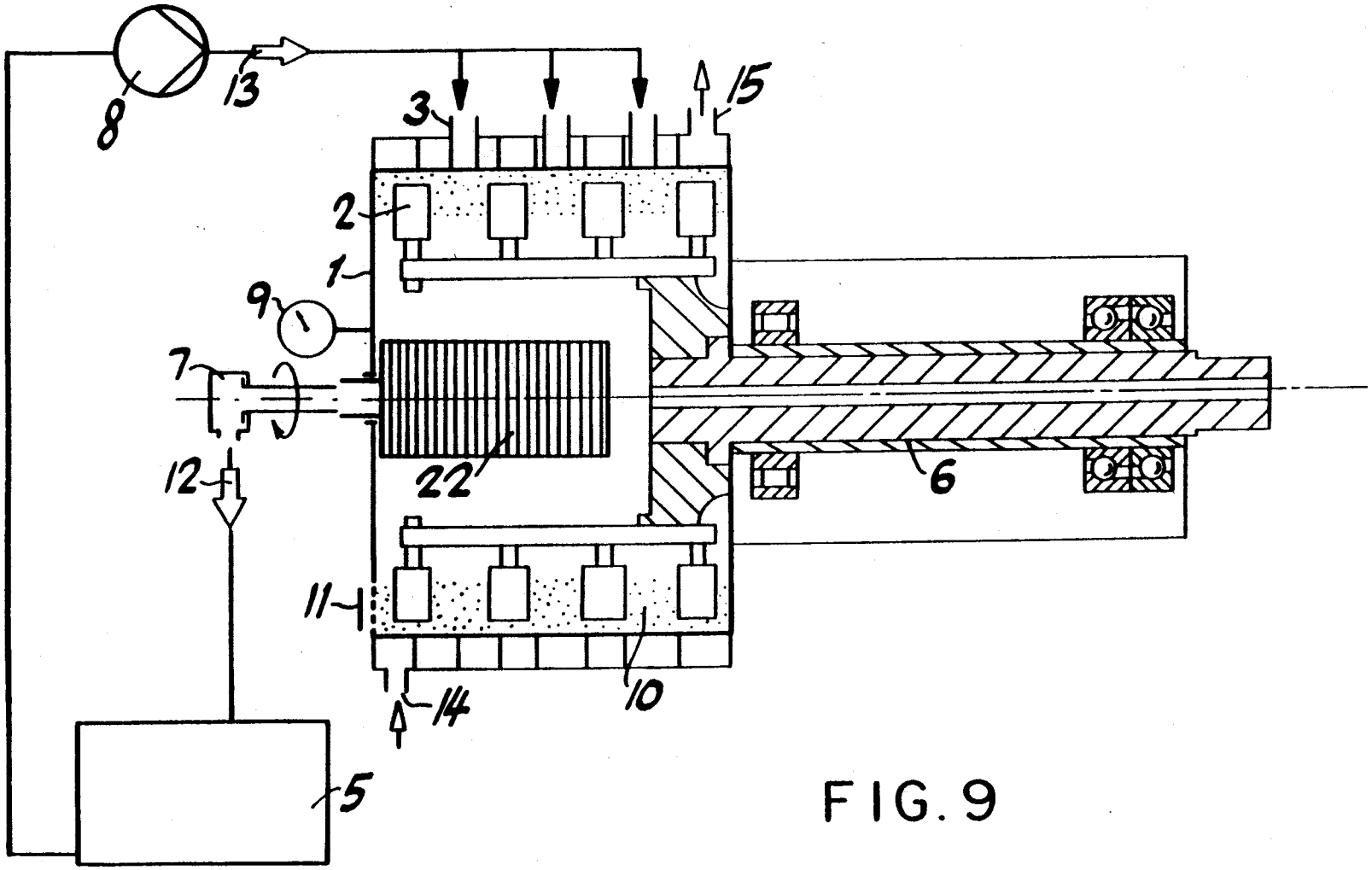

FIG. 3 shows the variation of the fineness of a suspension as a function of time, FIG. 4 shows a section corresponding to FIG. 1 but with a stationary cylindrical separating sieve, FIG. 5 shows a section through a stirred ball mill according to FIG. 1 but with sieves arranged along part of a circle, FIG. 6 shows a section according to FIG. 2 through the stirred ball mill according to FIG. 5, FIG. 7 shows a stirred ball mill with stationary sieves, FIG. 8 shows a stirred ball mill with a stationary syphon tube and FIG. 9 shows a stirred ball mill with a sieve rotating in the space free of grinding medium.

In the drawings, 1 denotes a container in which rotors 2 in the form of paddles are located. The mill base is fed in at 3, and 4 represents a sieve. 5 denotes a stock vessel. The rotors 2 are driven via a hollow shaft 6, which also serves for removal of the mill base. 7 represents a gland, and 8 denotes the required pump. 9 denotes a manometer and 10 denotes the grinding medium charge inside the container 1.

11 represents a discharge sieve for residual products, and the outflow of mill base is illustrated by arrow 12, while the inflow of mill base is illustrated by arrow 13. 14 represents the inflow of cooling water, and 15 represents the outflow of cooling water.

In FIG. 2, 16 represents an idealised mill base path, while the arrows 17 and 18 indicate, respectively, the radial velocity of the mill base and the peripheral velocity of the mill base.

Illustrative example:

| | |
|---|---|
| Mill base consisting of | 30.5% by weight of an alkyd resin<br>60.5% by weight of titanium dioxide<br>8.0% by weight of an aromatic solvent<br>1.5% by weight of additives |

90 kg of this mill base are predispersed in a dissolver. Thereafter, dispersing is carried out by means of the stirred ball mill shown in the figure.

Machine conditions:

Throughput: 900 kg/h

Rotary speed: 650 rpm

Effective power consumption: 10.8 kW

Grinding medium volume: 15 L

Type of grinding medium: Silicon/zirconium oxide grinding medium (diameter 0.6–2.5 mm)

Measurement of the maximum sizes of the solid particles according to Hegman gave a value of 100 μm after predispersing in the dissolver, and a value of 6 μm after dispersing for 30 minutes in the stirred ball mill. This gives a production rate of 180 kg/h.

It is known that grinding medium charges in stirred ball mills are subject to wear, the resulting loss of grinding medium must be replaced from time to time to ensure optimum operation, and the amount of grinding medium to be replaced is most advantageously determined via the power consumption of the rotating rotor of the stirred ball mill; however, in the case of stirred ball mills based on present-day technology, this is possible only with very expensive topping-up apparatuses, but is achieved in a surprisingly simple manner by the concept according to the invention, in which the required supplementary amounts of grinding medium can be metered, with the rotor running, freely via a feed pipe into the centre which is free of grinding medium, until a prescribed set value of the power consumption of the rotor is achieved.

In the graph shown in FIG. 3, the fineness (Xmax Hegman) of a suspension is plotted along the ordinate, as a function of time. The curve 19 shows that the suspension has reached a Hegman fineness of 35 μm after a pass corresponding to 400 minutes, and has reached a fineness of 19 μm after two passes corresponding to 780 minutes. The curve 20 shows that this result can be achieved in a substantially shorter time using a circulatory procedure.

FIG. 4 shows, as in FIG. 1, a cross-section through a stirred ball mill according to the invention, but in this case with a stationary cylindrical separating sieve 4.

FIGS. 5 and 6 show a section through a stirred ball mill, but in this case with sieves 4 arranged along part of a circle and rotating together with the drive shaft.

FIG. 7 shows sieves 4 which are arranged along part of a circle in a manner corresponding to FIG. 5 but in this case are in the form of stationary, i.e. non-rotating, sieves.

FIG. 8 shown, as the apparatus for separating off grinding medium, a stationary syphon tube 21 which projects into the space which is free of grinding medium. A sieve is not provided.

FIG. 9 shows, as the apparatus for separating off grinding medium, a sieve 22 which rotates in the space free of grinding medium and the speed of which is independent of the speed of the rotor drive.

We claim:

1. An apparatus for dispersing solids in a liquid phase, comprising:

a hollow body having a substantially cylindrical inner surface and containing a grinding medium;

rotation means in said hollow body for rotating said grinding medium relative to said hollow body at a speed such that said grinding medium forms an annular charge in contact on an outer side with said cylindrical inner surface and defining on its inner diameter a cylindrical space free of said grinding medium;

input means extending to said hollow body for feeding a mill base radially inwardly into said hollow body and through said annular charge, said mill base comprising solids and a liquid phase; and sieve means disposed inside said hollow body for sifting said mill base out from said grinding medium during a movement of said mill base radially inwardly through said cylindrical space.

2. The apparatus of claim 1 wherein said hollow body has a diameter and a length, said length having a ratio to said diameter of 0.5:1 to 1.5:1.

3. The apparatus of claim 1 wherein said input means includes a plurality of feed ports on an outer surface of said hollow body, said feed ports being longitudinally spaced from one another along said length.

4. The apparatus defined in claim 1 wherein said rotation means includes a plurality of paddles.

5. The apparatus defined in claim 1 wherein said sieve means includes a stationary sieve extending from a lowermost point of said hollow body a substantial distance into said hollow body.

6. The apparatus defined in claim 1 wherein said sieve means includes a cylindrical sieve disposed centrally in said hollow body.

7. The apparatus defined in claim 6 wherein said cylindrical sieve is rotatably disposed relative to said hollow body.

8. The apparatus defined in claim 7 wherein said hollow body has a predetermined length and wherein said sieve has a length at least 50% of said predetermined length.

9. The apparatus defined in claim 7 wherein said sieve is rotatable in a direction and at a speed independently of a direction and speed of rotation of said grinding medium relative to said hollow body.

10. The apparatus defined in claim 6 wherein said cylindrical sieve is stationary with respect to said hollow body.

11. The apparatus defined in claim 10 wherein said hollow body has a predetermined length and wherein said sieve has a length at least 50% of said predetermined length.

12. The apparatus defined in claim 1 wherein said sieve means includes a plurality of cylindrical sieves disposed in a circular array about a longitudinal axis of said hollow body.

13. The apparatus defined in claim 12 wherein said sieves are rotatable relative to said hollow body.

14. The apparatus defined in claim 13 wherein said hollow body has a predetermined length and wherein said sieves have a common length at least 50% of said predetermined length.

15. The apparatus defined in claim 1 wherein said sieves are stationary with respect to said hollow body.

16. The apparatus defined in claim 15 wherein said hollow body has a predetermined length and wherein said sieves have a common length at least 50% of said predetermined length.

17. The apparatus in claim 1, further comprising means for automatically sensing pressure of liquid in said space and means for controlling, in accordance with the sensed pressure, the speed of said rotation means relative to said hollow body.

18. The apparatus defined in claim 17, further comprising means for controlling, in accordance with the sensed pressure, the rate that said mill base is fed to said hollow body.

19. The apparatus of claim 1, wherein said hollow body has a predetermined volume and wherein said grinding medium occupies about 20–50% of said volume.

* * * * *

UNITED STATES PATENT AND TRADEMARK OFFICE

CERTIFICATE OF CORRECTION

PATENT NO. : 5,158,239

DATED : October 27, 1992

INVENTOR(S) : Vock et al.

It is certified that error appears in the above-identified patent and that said Letters Patent is hereby corrected as shown below:

Column 4, line 23, after "wherein" insert, --said hollow body has a diameter and a length and wherein--.

Column 4, line 66, change "sieves" to --sieve means--.

Column 5, line 1, change "sieves" to --sieve means--.

Signed and Sealed this

Seventeenth Day of January, 1995

*Attest:*

*Attesting Officer*

Bruce Lehman

BRUCE LEHMAN

*Commissioner of Patents and Trademarks*